US005297961A

United States Patent [19]

Hanson

[11] Patent Number: 5,297,961

[45] Date of Patent: Mar. 29, 1994

[54] DENTAL CONTROL UNIT WITH ARTICULATED WHIP ARMS

[75] Inventor: Richard W. Hanson, Sherwood, Oreg.

[73] Assignee: MDT Corporation, Torrance, Calif.

[21] Appl. No.: 50,868

[22] Filed: Apr. 20, 1993

[51] Int. Cl.[5] ..... A61G 15/00

[52] U.S. Cl. ..... 433/77

[58] Field of Search ..... 433/77, 78, 79, 28

[56] References Cited

U.S. PATENT DOCUMENTS

| | | | |
|---|---|---|---|
| 3,740,852 | 6/1973 | Holmqvist | 433/77 |
| 4,114,273 | 9/1978 | McGaha | 433/78 |
| 4,251,211 | 2/1981 | Plowman et al. | 433/77 |
| 4,345,616 | 8/1982 | Jerry | 433/78 |
| 4,470,811 | 9/1984 | Heubeck | 433/77 |
| 5,158,453 | 10/1992 | Brockway | 433/77 |

FOREIGN PATENT DOCUMENTS

| | | | |
|---|---|---|---|
| 2802093 | 7/1979 | Fed. Rep. of Germany | 433/77 |
| 3514831 | 11/1986 | Fed. Rep. of Germany | 433/77 |

*Primary Examiner*—Cary E. O'Connor
*Attorney, Agent, or Firm*—Trask, Britt & Rossa

[57] ABSTRACT

A dental control unit having conduit-carrying whip arms pivotally mounted on a base so as to leave top and side surfaces of a housing covering the base entirely free of seams or openings where oral cavity spray can enter; and conduits for dental handpieces that enter the whip arms at pivot connections for the arms inside the housing, such that the pivot connections and the portions of the conduits entering the whip arms are protected from oral cavity spray.

20 Claims, 3 Drawing Sheets

DENTAL CONTROL UNIT WITH ARTICULATED WHIP ARMS

BACKGROUND OF THE INVENTION

1. Field

This invention relates to dental control units. It is particularly directed to easily cleaned and sterilized dental control units of the "Continental" type, having pivoting arm supports for conduits connected to dental handpieces.

2. State of the Art

Dental control units provide for chairside positioning of dental handpiece-supporting trays. They usually include control structure for the handpieces. The control units are supported for pivotal movement on a cantilevered swinging arm so that they may be positioned closely adjacent the oral cavity of a dental patient. They are intended to be easily accessible to a dentist or dental technician, without obstructing the view or necessary operating room of the dentist and without being obtrusive to a patient.

Dental control units in general include a base mounted to swing with and to pivot on a support arm. A housing fits over the base to provide a cover for control mechanisms carried by the base and serving as flow control means for utility supply conduits extending from the base. Typical such dental control units support a plurality of dental handpieces, the associated utility supply conduits and structure for controlling flow through the conduits.

U.S. Pat. No. 4,173,827, for example, discloses a module control block assembly to individually control drive air and air and water coolants to conduits to which dental handpieces are connected.

U.S. Pat. No. 4,230,452 discloses a multiple dental handpiece control system in which lifting one handpiece out of its hangar blocks supply of power and coolants to all other handpieces. Each handpiece has an individual control unit and a blockout unit. When a handpiece is lifted from its hangar, it activates a valve to cause a piston in its control unit to shift to an operating condition. Power and coolant fluid are thus supplied to that handpiece. Power to the pistons in the other control units is simultaneously blocked, thereby preventing flow of power and coolant fluids to the other handpieces.

In "Continental" style dental control units, the supply conduits extend through semi-rigid, pivoted support arms. These arms are provided to maintain separation of the conduits, to prevent tangling of the conduits and other structure and to ensure proper positioning of the handpieces on the top surface of the housing when not in use. The conduits terminate in quick release ends to which dental handpieces are attached, and provide means for supplying vacuum, water, air and various solutions to the handpieces. Each handpiece has an individual control unit and a blockout unit. When a handpiece is lifted from its hangar, it activates a valve to cause a piston in its control unit to shift to an operating condition. Power and coolant fluid are thus supplied to that handpiece. Power to the pistons in the other control units is simultaneously blocked, thereby preventing flow of power and coolant fluids to the other handpieces.

In general, the support arms of previously known "Continental" type control units have been pivotally connected to an upper rear surface of a base of a dental control unit. As so connected, they swing from the pivot connection forwardly and rearwardly with respect to the unit between a use and rest position, respectively. These support arms are conventionally referred to as "whips" or "whip arms." A conduit is passed through each whip arm. A proximal end of the conduit is connected to a flow control valve mounted on the base, inside the housing. A distal free end of the conduit carries a connector to which a dental handpiece may be attached. An intermediate portion of each conduit is passed through a whip arm. When the dental handpiece is grasped, lifted off a hangar, or top tray surface, of the housing and moved towards a patient in a dental chair, the whip arm rotates about its pivot connection and forwardly towards and over the dental control unit housing.

Dental control units having whip arms to support the conduits attached to dental handpieces have been widely accepted. However, the whip arms heretofore used have been connected at, or adjacent to, the top surface of a dental unit so that the entire pivot connection assembly is exposed to oral cavity spray. The pivot connection, if exposed to the spray, must be disinfected between use of the assembly with different patients. Currently, barrier protection is relied upon to eliminate the need for disinfection after each patient treatment, but this expedient is generally unsatisfactory. An improperly positioned barrier is ineffective. A properly positioned barrier, from the standpoint of effectiveness, tends to obstruct proper pivoting of the arms.

The conduits of currently conventional Continental units exit the housing of the dental unit before entering the whip arms. Accordingly, portions of these conduits are exposed to spray contamination. Conduits which are contaminated in this fashion are difficult to clean in compliance with modern asepsis requirements.

SUMMARY OF THE INVENTION

The present invention provides a dental control unit that is easily cleaned and sanitized. The control unit includes a base that is entirely covered with a housing and a removable top cover over the housing. Whip arms are mounted to pivot from and beneath the base. Conduits from within the housing are passed into the whip arms beneath the base and exit the whip arms above the removable top cover. The proximal ends of the conduits are connected to utilities at the base beneath the cover. Dental handpieces are releasably coupled to the distal ends of the conduits. The connections between the base and whip arms are entirely out of the path of any oral spray occurring during a dental procedure.

A dental control unit of this invention thus provides conduit-carrying whip arms pivotally mounted on a base in an arrangement that leaves top and side surfaces of a housing covering the base entirely free of seams or openings where oral cavity spray could otherwise enter.

The mounting of the whip arms to the base of the control unit also allows the assembly to be constructed with a low profile. A low profile assembly is less apt to obscure lighting directed to the oral cavity of a patient than is common with existing Continental style dental control units.

The present invention further provides a connection mechanism of improved versatility for the whip arms of dental control units. This mechanism permits not only forward and reverse pivoting of the whip arms in a pivot plane, but also permits the arms to be rotated with respect to the pivot plane as the arms are moved to their use positions. This additional rotating motion greatly increases the range of movement permitted of the dental handpiece connected to a conduit passed through a whip arm. Preferably, the connection mechanism of this invention is structured and arranged to assure the reorientation of a whip arm to the pivot plane as it is returned to its rest position. In this fashion, proper spacing of dental handpieces connected to conduits passed through the whip arms and rested on a top tray surface of the dental control unit housing is maintained.

According to the exemplary embodiment, the proximal end of each whip arm is attached to a base support by structure which permits two-plane motion of the whip arm with respect to the base support. One suitable such structure comprises first and second structural members journaled to pivot on respective first and second pivot axes, the first and second axes being transverse, usually approximately normal, to each other.

The first such structural member may comprise a rigid arm journaled on a pivot post structurally associated with the second such structural member. For example, the pivot post may comprise a rotatable structural component mounted to rotate about an axis approximately normal the central axis of the pivot post. The pivot post thus provides a first pivot axis and is mounted to itself pivot about the second pivot axis.

The entire connection mechanism is housed within the dental control unit housing where it is protected against oral cavity spray occurring during dental procedures. The second pivot axis may conveniently be oriented to provide for the conventional forward and return travel of the whip arms in the conventional approximately vertical pivot plane. The whip arms may extend from within the housing and through appropriate openings in the base. Each such opening provides clearance for swinging of a whip arm transverse the vertical pivot plane as the arm and associated conduit are moved to and held in use position.

The present invention also provides for a light biasing return on the conduits attached to the dental handpieces and passed through the whip arms. The whip arms and conduits are thereby biased into the vertical pivot plane and into the rest, or returned, position.

A typical dental control unit of this invention is structured with a base having a top surface, a front edge, and a rear edge. A housing covers the top surface of the base. At least one hip arm connector is pivotally mounted to the base, beneath the housing. It is constructed and arranged for movement between working and returned pivoted positions, respectively. A hollow whip arm is associated with each connector. Each whip arm has a proximal end and a distal end, the proximal end being connected to the corresponding connector. The whip arms are configured to extend from beneath to above the base in both the working and the returned positions of the associated connectors. A utility conduit, having a proximal end and a distal end, enters the proximal end of each of the whip arms beneath the housing. Each conduit passes through the associated whip arm so that the distal end of the conduit exits the distal end of its associated whip arm and rests on the top surface of the housing. A dental handpiece attachment mechanism is carried at the distal end of each conduit.

Ideally, the whip arm connectors are mounted to the base inside the housing such that each whip arm moves between the working and the returned positions within a slot formed in a rear edge of the base. The pivot arms are preferably mounted to swing with rotation of the whip arm connector and to rotate with respect to the whip arm connector. In certain embodiments, swinging motion of a whip arm is limited to within a portion of the slot in the rear edge of the base. Biasing means may be constructed and arranged to urge each whip arm to the returned position. Such a biasing means often includes a loop formed in the conduit entering the whip arm inside the housing. The biasing means typically includes a spring having one end secured to the whip arm connector and another end secured to the base.

DETAILED DESCRIPTION OF THE ILLUSTRATED EMBODIMENT

Figure 1:
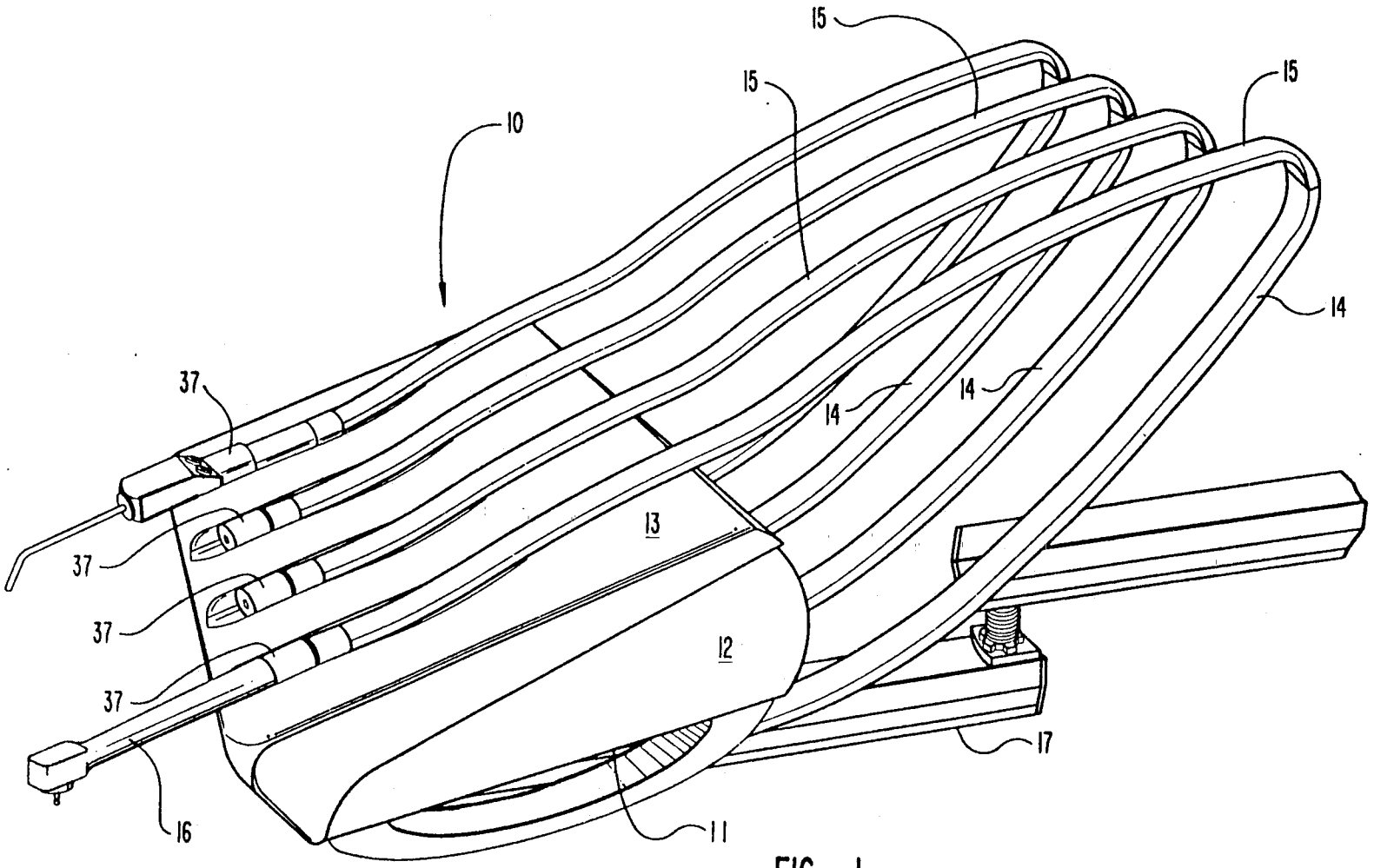
FIG. 1 is a perspective view of a dental control unit of the invention.
Figure 2:
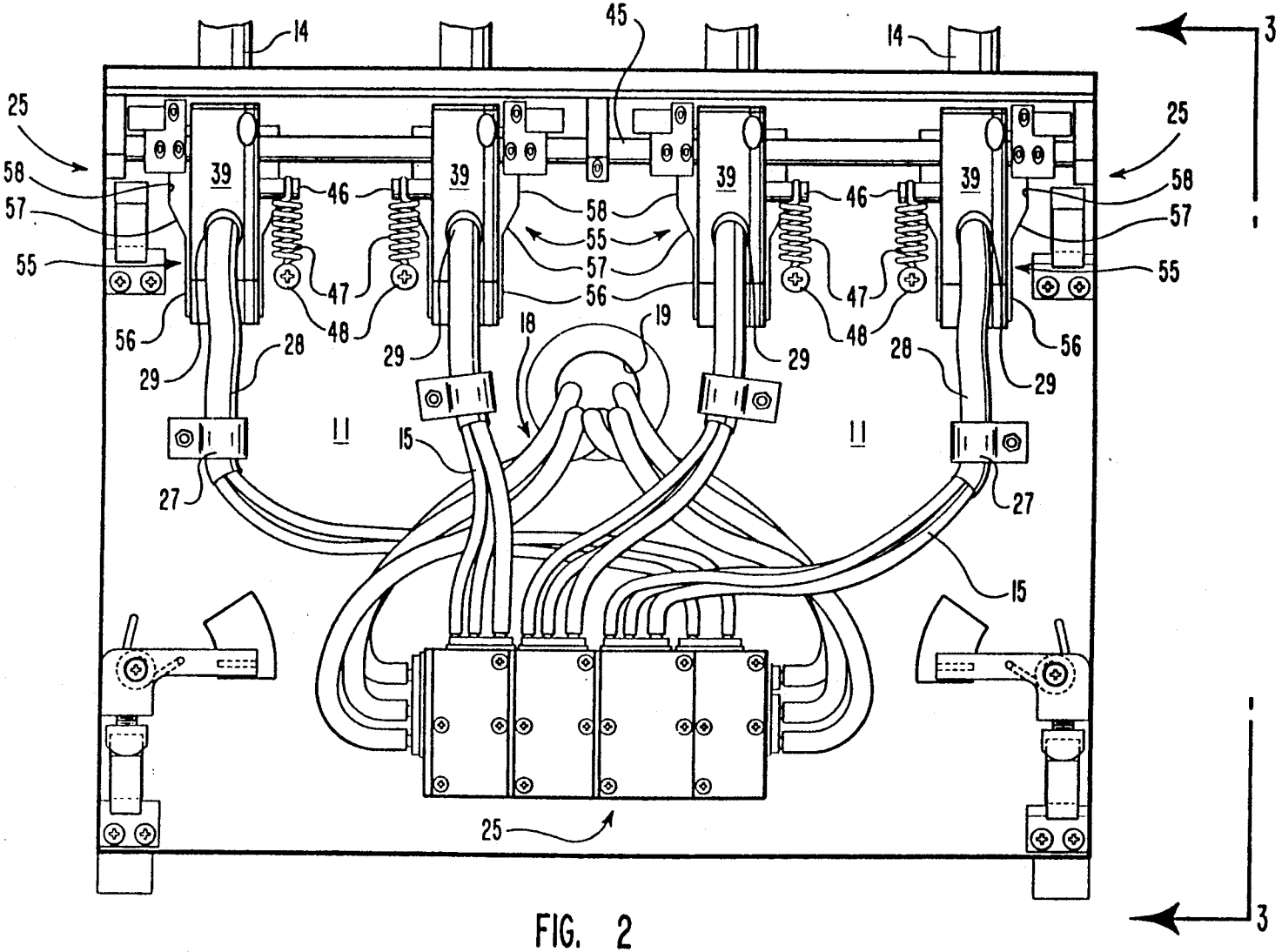
FIG. 2 is a top plan view of a base of the dental control unit of FIG. 1.
Figure 3:
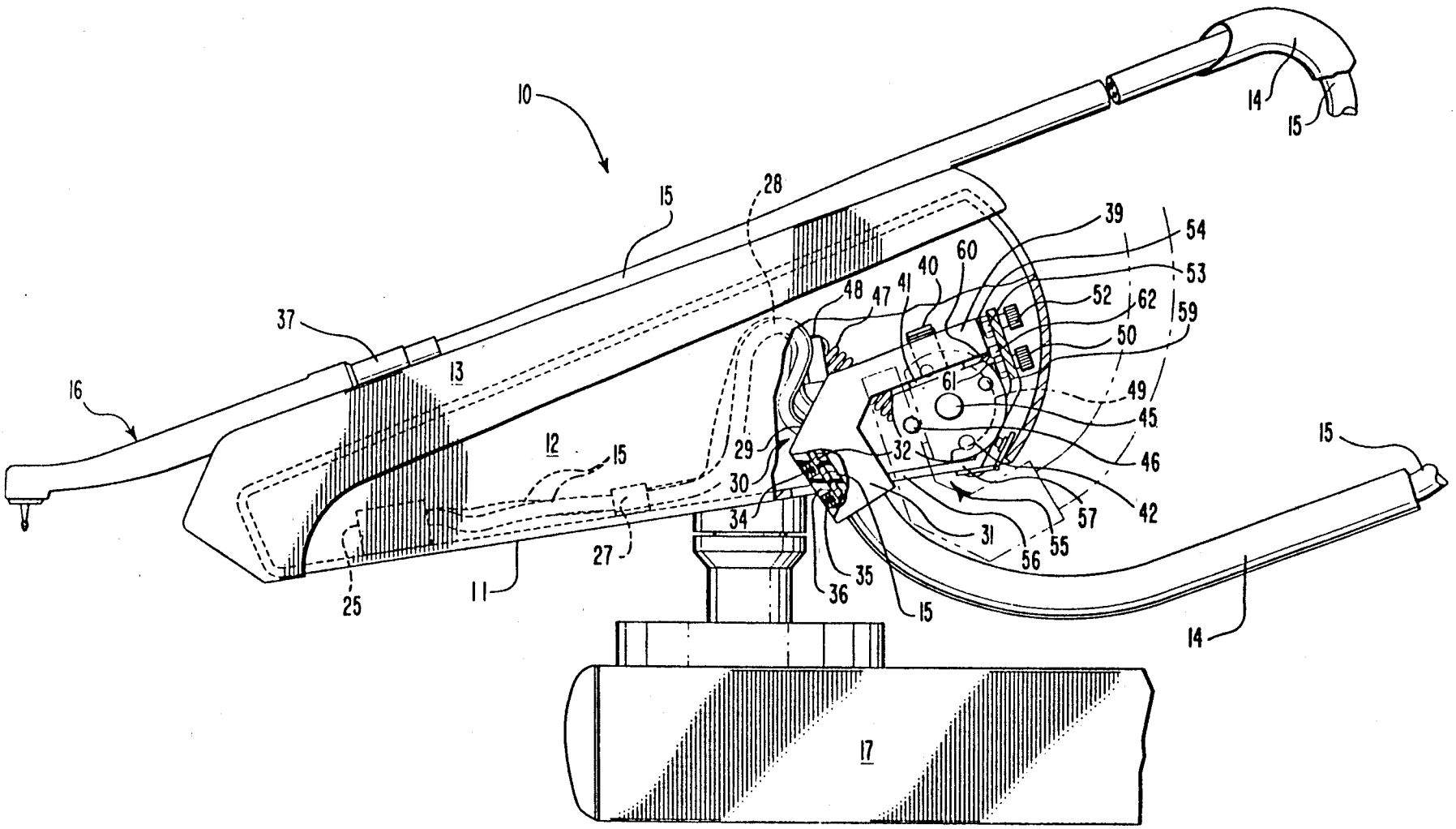
FIG. 3 is a side elevation view, partially broken away to show a whip arm mounting, and with an alternate position of the whip arm shown fragmentarily in phantom lines.

In the illustrated preferred embodiment of FIGS. 1–3, the dental control unit of the invention is shown generally at 10. Control unit 10 includes a base 11, a housing 12, a removable top cover 13, whip arms 14, and conduits 15. The control unit 10 may include a dental syringe or dental handpiece 16.

The base 11 is mounted to pivot on the free end of a cantilevered arm 17 and the dental control unit 10 is preferably positioned to be adjacent to the oral cavity of a dental patient positioned in a patient's chair. Liquid, air and suction conduits, shown generally at 18 in FIG. 2, are supplied through the cantilevered arm 17 and a hole 19 in the base 11 to modules of a control block 25 mounted on the base 11. Selected fluid flow between the control block 25 and each dental handpiece 16 is through one of the bundle conduits 15 and the nature of the fluid is controlled by an operator, using conventional means, not shown.

Each bundle conduit 15 passes through a clamp 27 fixed to the base 111. The clamp 27 does not obstruct flow through the conduit 15, but does prevent movement of the conduit at the clamp. Conduit 15 is formed into loop 28 and then passed through a hole 29 through a wall of a conduit support bracket 30, through the leg 31 of the bracket 30 and through a whip arm 14.

The whip arm 14 has one end 32 inserted into a leg 31 of the bracket 30 and secured in place by lock screws 34 and 35 threaded through a wall 36 of bracket 30 and into binding engagement with the end 32 of the whip arm 14. A connector 37 on the end of conduit 15 provides means for attachment of the handpiece 16 to the conduit.

Another leg 39 of the bracket 30 is journaled on a pivot post 40 fixed to and projecting from a flat chord surface 41 of a wheel 42. Each wheel 42 having a whip arm 14 secured thereto by bracket 31 and pivot post 40 is journaled to rotate about a pivot shaft 45 that extends fully across the base 11.

A pin 46 projects from one face of the wheel 42 and a light spring 47 is connected between the pin 46 and an anchor screw 48 threaded into base 11.

A groove 49 is formed in the periphery of wheel 42 and extends partially around the wheel. A stop screw 50, threaded through the base 11, extends into groove 49. Screw 50 is engaged by the end of the groove 49 to stop rotation of wheel 42 and the whip arm 14.

An adjustment screw 52 is threaded through a lock nut 53 and the base 11. Screw 52 engages an end 54 of bracket 30 to rotate the wheel 42 and bracket 30 as required to align each whip arm 14 with each other whip arm 14.

Leg 31 of bracket 30 extends from within the housing 12 through a slot 55 formed in the base 11.

Slot 55 has a narrow section 56 that is just wider than the width of the bracket 30. Slot 55 is also flared outwardly at 57, to an expanded section 58 located forward of a rear edge 59 of the base 11. The narrow section 56 serves to guide the bracket 30 into a central position as the whip arm 14 swings to its rest position, such that the arm does not engage another arm.

As a dental handpiece 16 is picked up off the top cover 13 and is moved by a dentist towards a patient, the whip arm 14 swings from its rest position, i.e. the solid line position of FIG. 3, to the use position shown in phantom lines. As the whip arm is pulled by the conduit 14, the wheel 42 rotates on the shaft 45. Once the bracket 30 clears the narrow section 56 of slot 55, the whip arm is able to pivot about pin 40 and to swing from side to side, with the greatest pivoting latitude occurring when the whip arm 14 is pivoted fully into the expanded section 58. The pivoting movement afforded the mounting of bracket 30 on wheel 42 allows a user of a handpiece to move it easily and freely, without resistance from conduit support mechanism, since the conduit support mechanism will move with such handpiece movement, rather than resisting such movement.

A cam 60 is formed on a portion 61 of wheel 42. Cam 60 engages a switch 62 that is mounted on shaft 45 to hold the switch open and to allow the switch to close when the whip arm 14 is moved from its rest position and the cam moves away from the switch. Switch 62, when actuated, controls a valve in control block 25 to allow flow through conduit 15. When the whip arm 14 is moved back to its rest position cam 60 holds the switch open and the valve in control block 25 is deactivated and prevents flow through conduit 16.

With the whip arms 14 each mounted to a wheel 42 and the wheel positioned inside the housing such that the whip arm pivots from the base 11, the housing 12 and top cover 13, if provided, fully protect the connections of conduits 15 and the whip arms 14 from oral cavity spatter. No openings, cracks or crevices are required in the housing or top cover to permit full operation of the conduits 14 and whip arms 15. Consequently, spatter occurring during dental procedures is easily cleaned from the smooth surfaces of the top cover and/or housing. The exposed portions of the conduits 15 and whip arms 14 are easily wiped to be cleaned and sanitized.

While a preferred embodiment of the invention has been herein disclosed, it is intended that the invention be defined only by the appended claims, including reasonable equivalents.

What is claimed is:

1. A dental control unit comprising:

a base having a top surface, a front edge, a rear edge, and at least one slot formed through said base at said rear edge thereof;

a housing covering said top surface of said base;

at least one whip arm mounting means on said top surface of said base pivotally mounting a whip arm to swing through a said slot at said rear edge of said base from a rest position to a use position;

a conduit for each said whip arm, each said conduit having one end entering said whip arm in said housing, extending through said whip arm and having the other end of said conduit projecting from said whip arm;

a connector member on said other end of said conduit;

a dental handpiece connected to said connector member; and means on the housing to position each said connector member and dental handpiece connected thereto, when said whip arm is in the rest position.

2. A dental control unit as in claim 1, further including:

a control box mounted on said base inside said housing, said control box including valve means for each conduit;

means connecting an end of each conduit in said housing to said control box;

a switch for each whip arm mounted to said base and operable, when activated, to allow flow through said conduit; and cam means movable with said whip arm to actuate said switch in response to movement of said whip arm away from said rest position.

3. A dental control unit as in claim 2, further including:

a resilient loop formed in said conduit; and means clamping said conduit to said base at a location between said control box and said whip arm, whereby the coil biases the whip arm and conduit carried thereby to the rest position of said whip arm.

4. A dental control unit as in claim 3, further including spring means connected between said base and said whip arm to assist in biasing said whip arm to said rest position.

5. A dental control unit as in claim 4 wherein said means on the top surface of said base pivotally mounting each said whip arm to swing through said slot in the base comprises:

a shaft fixed to said base;

a wheel journaled on said shaft; and means fixing said whip arm to the periphery of said wheel whereby said whip arm swings with rotation of said wheel.

6. A dental control unit as in claim 5, further including a bracket having one arm pivotally connected to a flat chord of said wheel and another arm having said conduit passed therethrough.

7. A dental control unit as in claim 6, wherein said slot through said base has a narrow portion just wider than said other arm of said bracket for a length thereof and flares outwardly to an enlarged section of said slot at the rear edge of said base whereby the bracket is free to pivot with respect to said flat chord when said other arm is moved out of said narrow portion.

8. A dental control unit as in claim 7, wherein said conduit is passed through said other arm of said bracket.

9. A dental control unit as in claim 1 wherein said means on the top surface of said base pivotally mounting each said whip arm to swing through said slot in the base comprises:

a shaft fixed to said base;

a wheel journaled on said shaft; and means fixing said whip arm to the periphery of said wheel whereby said whip arm swings with rotation of said wheel.

10. A dental control unit as in claim 9, further including a bracket having one arm pivotally connected to a flat chord of said wheel and another arm having said conduit passed therethrough.

11. A dental control unit as in claim 10, wherein said slot through said base has a narrow portion just wider than said other arm of said bracket for a length thereof and flared outwardly to an enlarged portion of said slot at said rear edge of said base, whereby said bracket is free to pivot on said wheel when said other arm is moved out of said narrow portion.

12. A dental control unit as in claim 11, wherein said conduit is passed through said other arm of said bracket.

13. A dental control unit comprising:

a base having a top surface, a front edge, and a rear edge;

a housing covering said top surface of said base;

at least one whip arm connector pivotally mounted to said base, beneath said housing, constructed and arranged for movement between working and returned pivoted positions, respectively;

a hollow whip arm associated with each said connector, each said whip arm having a proximal end and a distal end, the proximal end being connected to a said connector and each said whip arm being configured to extend from beneath to above said base in both said working and said returned positions;

a conduit, having a proximal end and a distal end, entering the proximal end of each said whip arm beneath said housing and passing through said whip arm, the distal end of each said conduit exiting the distal end of said whip arm to rest on said top surface of said housing; and a dental handpiece attachment mechanism carried at the distal end of each said conduit.

14. A dental control unit according to claim 13 wherein:

each said whip arm connector is mounted to said base, inside said housing.

15. A dental control unit according to claim 14 wherein:

each said whip arm is mounted to move between said working and said returned positions within a slot formed in a rear edge of said base.

16. A dental control unit according to claim 14 wherein: each said whip arm is mounted to swing with rotation of said whip arm connector and to rotate with respect to said whip arm connector.

17. A dental control unit according to claim 16 wherein:

each said whip arm is limited to swinging motion within a portion of a slot formed in said rear edge of said base.

18. A dental control unit according to claim 14, further including:

biasing means constructed and arranged to urge each said whip arm to a said returned position.

19. A dental control unit according to claim 18, wherein:

said biasing means includes a loop formed in said conduit entering said whip arm inside said housing.

20. A dental control unit according to claim 18, wherein:

said biasing means includes a spring having one end secured to said whip arm connector and another end secured to said base.

* * * * *